United States Patent [19]

Sakurai

[11] 4,041,966

[45] Aug. 16, 1977

[54] ONE HAND OPERATED UMBRELLA CAPABLE OF SELF-OPENING

[76] Inventor: Seiya Sakurai, 210 - 17th Ave., South, Seattle, Wash. 98144

[21] Appl. No.: 700,059

[22] Filed: June 25, 1976

[51] Int. Cl.[2] ..... A45B 25/16

[52] U.S. Cl. ..... 135/22; 135/24

[58] Field of Search ..... 135/1 D, 2, 3 C, 4 B, 135/22, 24, 75

[56] References Cited

U.S. PATENT DOCUMENTS

| | | | |
|---|---|---|---|
| 2,917,060 | 12/1959 | Militano | 135/22 |
| 3,870,062 | 3/1975 | Medlin | 135/20 M |
| 3,926,202 | 12/1975 | Uthemann et al. | 135/20 M |

*Primary Examiner*—Werner H. Schroeder
*Assistant Examiner*—Conrad L. Berman

[57] ABSTRACT

This invention is directed to an umbrella whereby a person can open the umbrella with one hand and, also, close the umbrella with one hand. There is a spring which urges the umbrella to an open position. In the closed position there is a latching means for preventing movement of the elements of the umbrella so as to maintain the umbrella in the closed position. To open the umbrella the latching means is moved and the spring expands the umbrella to the open position. To close the umbrella a person, with one hand, pulls on a handle so as to move the latching means in a locking position to maintain the umbrella in the closed position.

1 Claim, 2 Drawing Figures

ONE HAND OPERATED UMBRELLA CAPABLE OF SELF-OPENING

This invention relates to a self-opening umbrella, and the principal object is to provide both opening and closing operations with one hand by means of pushing action of a hand for automatic opening and squeezing action of the same hand for closing while retaining simplicity in construction. This one hand operation of umbrella greatly facilitates user whose other hand is occupied and is not readily available for umbrella configuration change.

Another object of the invention is to provide the user an instant and ready infinitesimal umbrella configuration changes between open and close positions, enabling the user to utilize the squeezing motion to partially close the umbrella with ease when passing through narrow passages, while retaining complete umbrella function.

A still further object is to provide in a device constructed as specified, an inner shaft, an upper hub member secured to the top of the inner shaft, a plurality of ribs supporting an umbrella cloth and pivotally engaged at one end to the circumference of the upper hub member, a pin secured to the lower end of the inner shaft, two symmetrical upper handle grips securely attached to the pin, a tubular outer shaft slidably mounted on the inner shaft having a lower end a dual longitudinal slot for the pin protrusions, a lower handle grip secured to the bottom of the tubular outer shaft, a plurality of rib-supporting spokes each pivotally engaged at one end to the lower hub member and at the other end to the intermediate portion of the ribs, a compression spring means mounted on the shaft between the upper and lower hub members and forcing the pin in the inner shaft against the top portion of the dual longitudinal slots in the tubular outer shaft, thereby stabilizing the umbrella in open configuration, and when the upper handle grips are squeezed down against the force of compression spring means to contact the lower grip to create simultaneously to the ribs inward and downward moment caused by radially differential inside support pivots on the ribs and the rib-supporting spokes moving in different paths to close umbrella, a latch means provided in the lower portion of the inner shaft protrudes out and prevents the inner shaft from moving up, thus retains the umbrella in closed configuration, whereby, upon pressing and releasing the latch means, the inner shaft is caused to move upward by the compression spring means creating outward moment to the ribs, thereby automatically opening the umbrella.

IN THE ACCOMPANYING DRAWING

Figure 1:
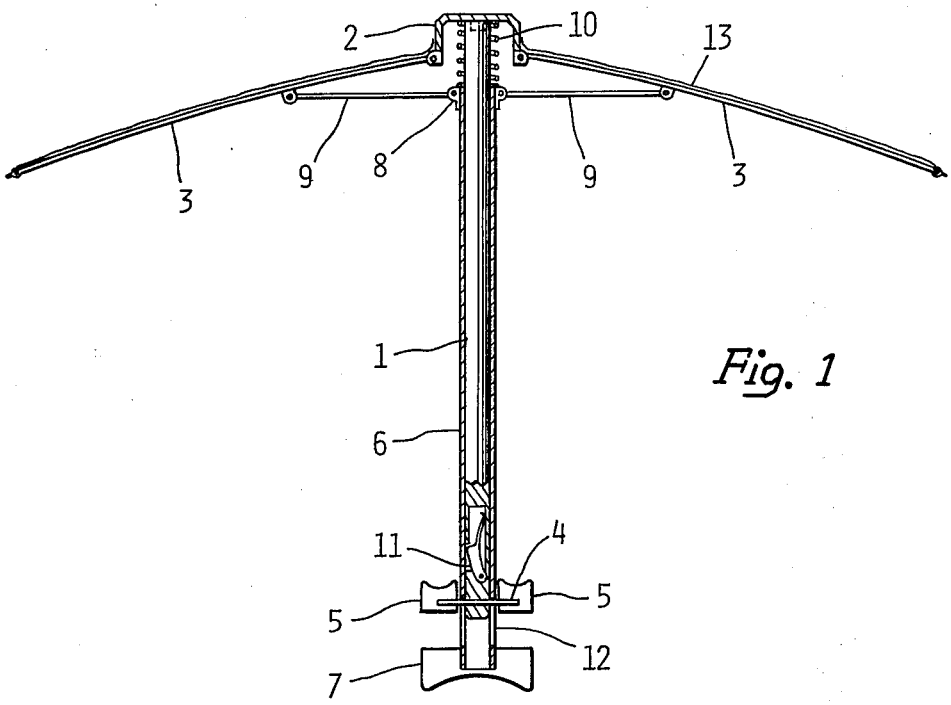
FIG. 1 is a longitudinal side view, partially in section, of the one hand operated umbrella capable of self-opening, constructed according to this invention, in open configuration.
Figure 2:
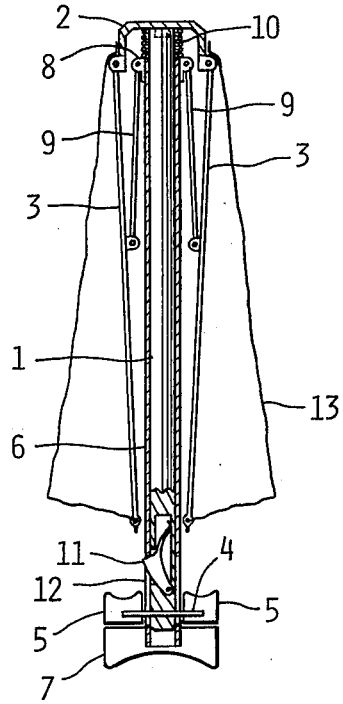
FIG. 2 is a longitudinal side view, partially in section, of the umbrella in closed configuration.

Reference is now made to the FIGS. 1 and 2:

The one hand operated umbrella of this invention has an inner shaft 1, an upper hub member 2 secured to the top of the inner shaft 1, a plurality of ribs 3 each supporting an umbrella cloth 13 and pivotally engaged at one end to the circumference of the upper hub member 2, a pin 4 through and secured to the lower end of the inner shaft 1, two symmetrical upper handle grips 5 securely attached to the pin 4, a tubular outer shaft 6 concentrically and slidably mounted on the inner shaft 1 and having at lower end dual longitudinal slots 12 for the pin 4 protrusions, a lower handle grip 7 secured to the bottom of the tubular outer shaft 6, a lower hub member 8 secured to the top of the tubular outer shaft 6, a plurality of rib-supporting spokes 9 each pivotally engaged at one end to the lower hub member 8 and at the other end to the intermediate portion of the ribs 3, a compression spring means 10 mounted on the inner shaft 1 between the upper hub member 2 and the lower hub member 8 and forcing the pin 4 in the inner shaft 1 against the top portions of the dual longitudinal slots 12 in the tubular outer shaft 6, thereby stabilizing the umbrella in open configuration, and when the upper handle grips 5 are squeezed down against the force of the compression spring means 10 to contact the lower handle grip 7 to create simultaneously to the ribs 3 inward and downward moments caused by radially differential inside support pivots on the ribs 3 and the rib-supporting spokes 9 moving in different paths to close the umbrella, a latch means 11 provided in the lower portion of the inner shaft 1 protrudes out and prevents the inner shaft 1 from moving up thus retains the umbrella in closed configuration, whereby, upon pressing and releasing the latch means 11, the inner shaft 1 is caused to move upward by the compression spring means 10 and creating outward moment of the ribs 3, thereby automatically opening the umbrella.

Representative embodiment of this invention is herein presented, but it is easily acknowledged that the particular embodiment is not the only form to attain the true scope of the invention, and there are still other alternative forms which come within the same range and extent of the invention as defined in the appended claim.

I claim:

1. A one hand operated umbrella comprising: an inner shaft, an upper hub member secured to the top of the inner shaft, a plurality of ribs each supporting an umbrella cloth and pivotally engaged at one end to the circumference of the upper hub member, a pin through and secured to the lower end of the inner shaft, two symmetrical upper handle grips securely attached to the pin, a tubular outer shaft concentrically and slidably mounted on the inner shaft and having at lower end dual longitudinal slots for the pin protrusions, a lower handle grip secured to the bottom of the tubular outer shaft, a lower hub member secured to the top of the tubular outer shaft, a plurality of rib-supporting spokes each pivotally engaged at one end of the lower hub member and at the other end to the intermediate portion of the ribs, a compression spring means mounted on the inner shaft between the upper hub member and the lower hub member and forcing the pin in the inner shaft against the top portions of the dual longitudinal slots in the tubular outer shaft, thereby stabilizing the umbrella in open configuration, and when the upper handle grips are squeezed down against the force of the compression spring means to contact the lower handle grip to create simultaneously to the ribs inward and downward moments caused by radially differential inside support pivots on the ribs and the rib-supporting spokes moving in different paths to close the umbrella, a latch means provided in the lower portion of the inner shaft protrudes out and prevents the inner shaft from moving up thus retains the umbrella in closed configuration, whereby, upon pressing and releasing the latch means, the inner shaft is caused to move upward by the compression spring means and creating outward moment of the ribs, thereby automatically opening the umbrella.

* * * * *